US009883983B2

(12) United States Patent
Khalfi

(10) Patent No.: US 9,883,983 B2
(45) Date of Patent: Feb. 6, 2018

(54) MOTORIZED STRETCHING MACHINE

(71) Applicant: Aziz Khalfi, San Francisco, CA (US)

(72) Inventor: Aziz Khalfi, San Francisco, CA (US)

( * ) Notice: Subject to any disclaimer, the term of this patent is extended or adjusted under 35 U.S.C. 154(b) by 369 days.

(21) Appl. No.: 14/843,907

(22) Filed: Sep. 2, 2015

(65) Prior Publication Data

US 2017/0056273 A1 Mar. 2, 2017

(51) Int. Cl.
*A61H 1/02* (2006.01)

(52) U.S. Cl.
CPC ..... *A61H 1/0244* (2013.01); *A61H 1/0255* (2013.01); *A61H 2001/0248* (2013.01); *A61H 2201/0119* (2013.01); *A61H 2201/0165* (2013.01); *A61H 2201/1207* (2013.01); *A61H 2201/1284* (2013.01); *A61H 2201/14* (2013.01); *A61H 2201/1454* (2013.01); *A61H 2201/169* (2013.01); *A61H 2201/1635* (2013.01); *A61H 2201/1642* (2013.01); *A61H 2201/1664* (2013.01); *A61H 2201/5033* (2013.01); *A61H 2201/5035* (2013.01); *A61H 2201/5043* (2013.01); *A61H 2203/0406* (2013.01); *A61H 2203/0437* (2013.01)

(58) Field of Classification Search
CPC ..... A61H 1/0244; A61H 1/0255; A61H 2001/0248; A61H 2203/0403; A61H 2203/0437; A61H 2201/0119; A61H 2201/0165; A61H 2201/1207; A61H 2201/1284; A61H 2201/14; A61H 2201/1454; A61H 2201/1635; A61H 2201/1642; A61H 2201/1664; A61H 2201/169; A61H 2201/5033; A61H 2201/5035; A61H 2201/5043
See application file for complete search history.

(56) References Cited

U.S. PATENT DOCUMENTS 5,254,060 A * 10/1993 Bohanan ..... A61H 1/0255 482/57
5,449,336 A * 9/1995 Sabel ..... A61H 1/0218 482/130
5,662,592 A * 9/1997 Brady ..... A63B 23/04 482/139
6,019,740 A * 2/2000 Hausman ..... A61H 1/0274 482/907
6,210,348 B1 * 4/2001 Reed ..... A61H 1/0292 482/72

(Continued)

*Primary Examiner* — Joshua T Kennedy

(57) ABSTRACT

A motorized stretching machine for enabling a user to perform stretches targeting areas throughout their body includes a metal base frame with an integral slide track on which a motor driven foot rest apparatus is mounted, a plurality of hand grip frames that enables many different hand grips, and a plurality of foot stands. A plurality of push buttons are disposed in various locations on the right side and left side to allow the user to control the operation of the motor driven foot rest apparatus. The varied positioning of the push buttons facilitates full control during stretches and full stability because the user can hold onto other parts of the machine to assist with balance while actuating the motor control buttons. Advantageously, the overall design helps users engage selected muscle groups without losing balance or flexing any other muscles so the user can enjoy a full stretch.

16 Claims, 6 Drawing Sheets

(56) References Cited

U.S. PATENT DOCUMENTS

| | | | | |
|---|---|---|---|---|
| 6,261,250 | B1 * | 7/2001 | Phillips | A63B 21/0058 482/121 |
| 7,108,664 | B2 * | 9/2006 | Mason | A61H 1/0277 601/33 |
| 7,137,959 | B2 * | 11/2006 | Phillips | A61H 1/0237 482/51 |
| 7,303,517 | B2 * | 12/2007 | Pandozy | A61H 1/0218 482/144 |
| 7,563,207 | B1 * | 7/2009 | Burek | A61H 1/0218 482/131 |
| 7,604,583 | B2 * | 10/2009 | Denisco | A61H 1/0244 482/142 |
| 8,602,948 | B2 * | 12/2013 | Bohanan | A63B 21/068 482/57 |
| 2014/0296040 | A1 * | 10/2014 | Mobley | A63B 21/078 482/104 |

* cited by examiner

MOTORIZED STRETCHING MACHINE

BACKGROUND

Stretching is a form of physical exercise in which a specific skeletal muscle or muscle group is deliberately elongated, often by abduction from the torso, in order to improve the muscle's felt elasticity and reaffirm comfortable muscle tone. The result of stretching is a feeling of increased muscle control, flexibility and range of motion. Stretching is also used therapeutically to alleviate cramps. Increasing flexibility through stretching is one of the basic tenets of physical fitness. It is common for athletes to Stretch before and after exercise in order to reduce injury and increase performance.

Yoga involves the stretching of major muscle groups, some of which require a high level of flexibility to perform, for example the lotus position. Stretching can strengthen muscles, and in turn strong muscles are important to stretching safely and effectively. Stretching can be dangerous when performed incorrectly. There are many techniques for stretching in general, but depending on which muscle group is being stretched, some techniques may be ineffective or detrimental, even to the point of causing permanent damage to the tendons, ligaments and muscle fiber. The physiological nature of stretching and theories about the effect of various techniques are therefore subject to heavy inquiry.

There are many beneficial stretches that can improve range of motion (ROM) in athletes, especially runners. Certain stretching techniques and protocols prevent injuries when performed (within 15 minutes) prior to exercise. It is also suggested that one stretching exercise may not be enough to prevent all types of injury, and therefore, multiple stretching exercises should be used to gain the full effects of stretching. It has also been suggested that proprioceptive neuromuscular facilitation (PNF) stretching yield the greatest change in range of motion, especially short-term benefits. Reasoning behind the biomechanical benefit of PNF stretching points to muscular reflex relaxation found in the musculotendinous unit being stretched. Others suggest that PNF benefits are due to influence on the joint where the stretch is felt.

Stretching can be used for various purposes including: preparation, maintenance and development. Preparatory Stretching is focused on getting the muscles ready for exercise. The aim of preparatory stretching is to help prepare the muscles for exercise, this will reduce the risk of injury and improve performance during the exercise. Preparatory stretches should be performed after a warm up exercise and should be focused on the muscle groups that are going to be used during the exercise session.

Maintenance stretching is generally performed after a main exercise session. The purpose of maintenance stretching is to return the muscles back to their normal length. Stretching after your main exercise session is one of the most neglected areas of fitness. Looking after a body's flexibility by stretching will reduce the risk of injury, muscle tension, the risk of lower back pain and improve muscle coordination.

Developmental Stretching is also generally performed at the end of an exercise session. Developmental Stretches focus on increasing the muscle length or muscle flexibility. Developmental stretches are an excellent way of increasing your flexibility, usually performed after the main exercise session they are designed to improve your range of movement. Developmental stretching can be used to correct posture, reduce muscle cramps and gain more flexibility.

Most stretching is performed by moving the body in specific ways to elongate target muscles. In some cases, a hand may be needed to grasp another portion of the body and stretch a muscle. In other cases, the individual may lean against a stationary object to elongate the target muscle.

DETAILED DESCRIPTION OF THE INVENTION

Figure 1:
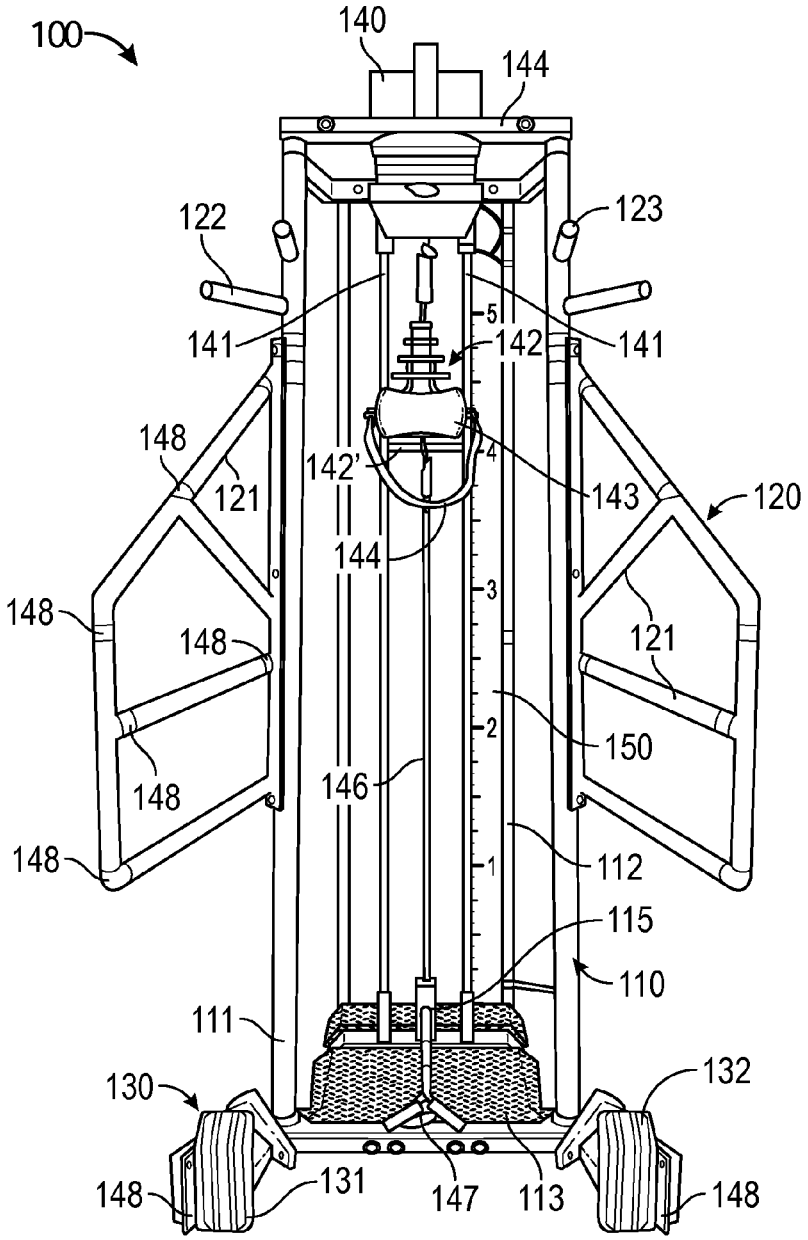
FIG. 1 is a front elevational view of a motorized stretching machine built in accordance with the preferred embodiment of the present invention with its foot rest apparatus in an elevated position.
Figure 2:
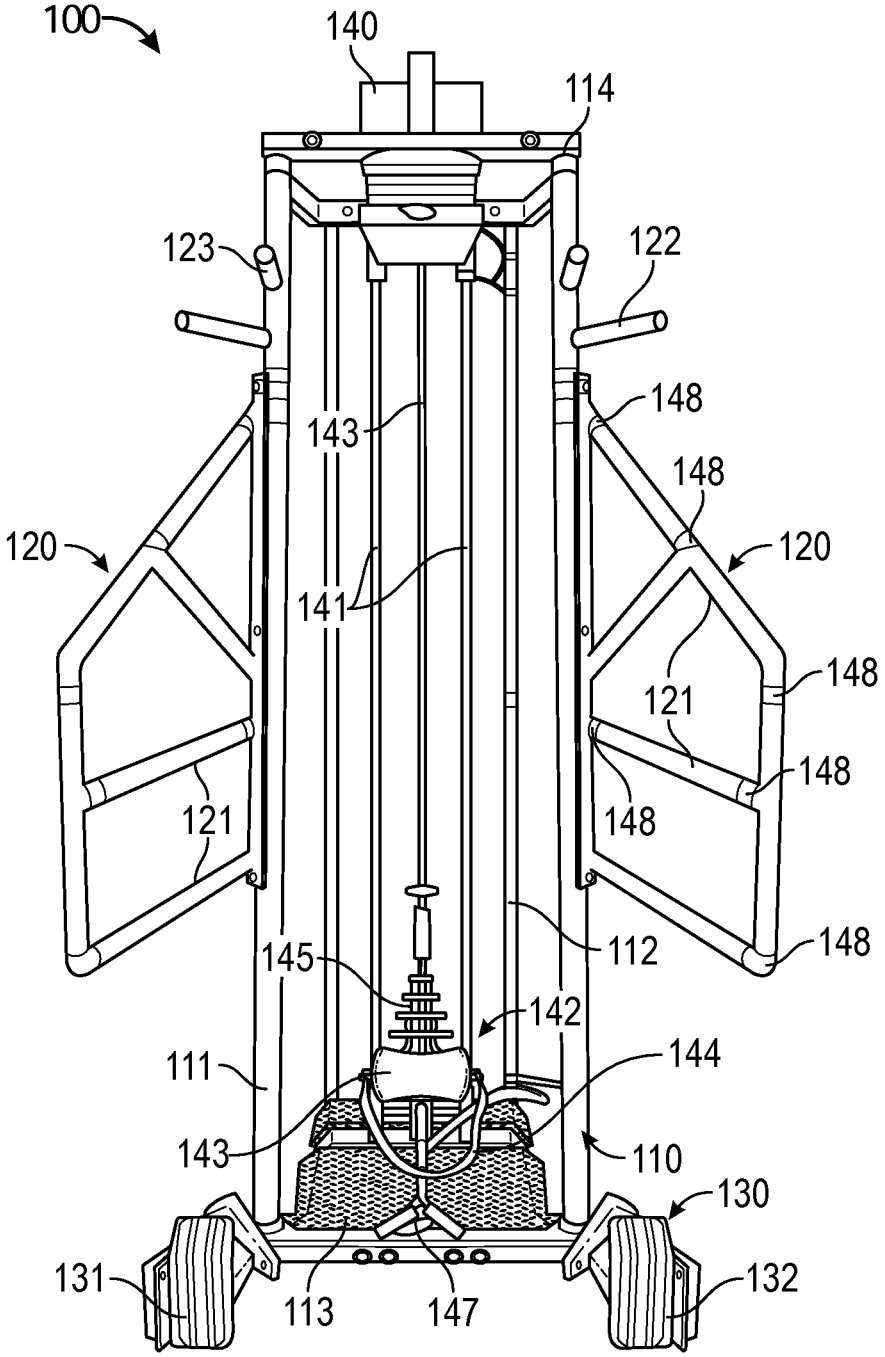
FIG. 2 is a front elevational view of a motorized stretching machine built in accordance with an embodiment of the present invention with the foot rest apparatus in a lowered position.
Figure 3:
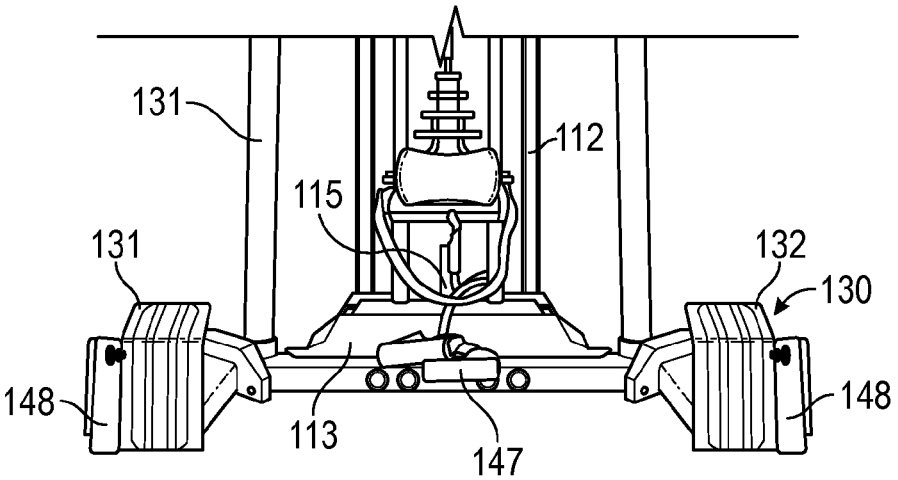
FIG. 3 is a front sectional view of the lower portion of a motorized stretching machine built in accordance with an embodiment of the present invention with the foot rest apparatus in a lowered position.
Figure 4:
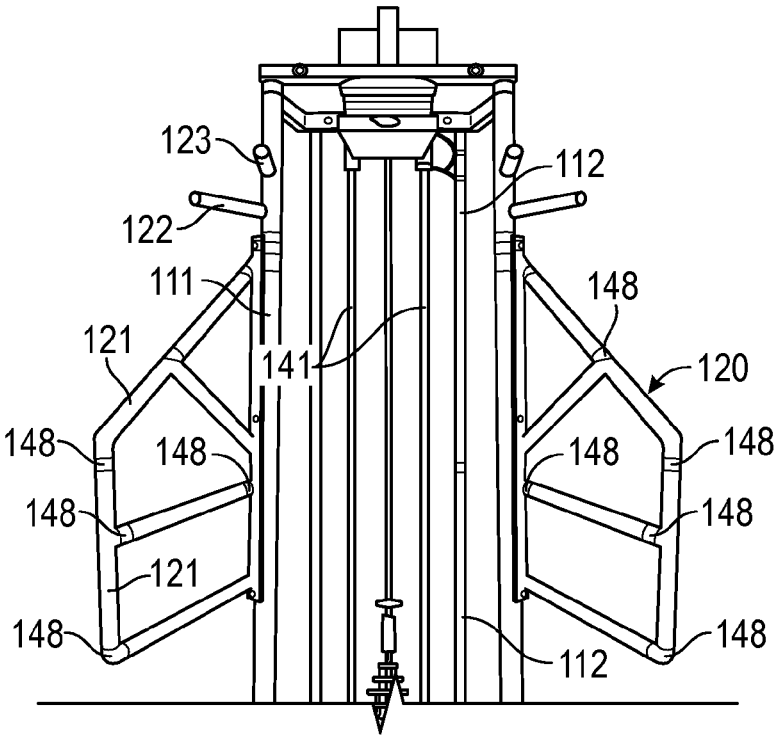
FIG. 4 is a front sectional view of the upper portion of a motorized stretching machine built in accordance with an embodiment of the present invention.

Referring now to the drawings and in particular FIGS. 1, 2, 3, 4, 5, 6, and 7, a motorized stretching machine 100 built in accordance with the preferred embodiment of the present invention is defined by a freestanding, elongated base frame 110 having a two proximal frame members 111 and two distal frame members 112, each of which extend vertically between a base stand 113 and a top section 114. Attached to the each of the proximal frame members 111 is a hand grip frame 120 defining a plurality of grip bars 121 arranged with as polygon with two crossbars, a lateral hand bar 122, and a front hand bar 123. Extending in front of the motorized stretching machine 100 from the bottom of each proximal frame member 111 is a rigid foot stand 130 that includes a sloped front 131 and a substantially flat top 132.

Integral with the motorized stretching machine 100 is a motorized assembly which defines an electric motor 140 mounted to the top section 114, a slide track 141 oriented substantially vertically between the electric motor 140 and the base stand 113, and a foot rest apparatus 142 slidably disposed on the slide track 141. In the preferred embodiment, the foot rest apparatus 142 is coupled with a cable 143 that extends from a spool (not shown) inside the electric motor 140. Accordingly, operating the electric motor 140 to rotate in a first direction causes the foot rest apparatus 142 to rise towards the electric motor 140 while operating the electric motor 140 to rotate in a second, opposing direction causes the foot rest apparatus 142 to be lowered away from the electric motor 140 towards the base stand 113.

It is appreciated that in some embodiments, the electric motor 140 may additionally include an internal gearing system so as to enable the speed or torque of the electric motor's rotation of the cable 143 around the spool to be controlled or to cause the foot rest apparatus 142 to be held in place when the motor 140 is off.

The slide track 141 operates as a guide rail along which the foot rest apparatus 142 is moved vertically between the electric motor 140 to the base stand 113. In the preferred embodiment, the slide track 141 defines two discrete pole members which each extend from the electric motor 140 to the base stand 113 in a substantially parallel orientation relative to the distal frame members 112. In such an embodiment, the foot rest apparatus 142 is coupled to each pole member of the slide track 141, thereby preventing the foot rest apparatus 142 from revolving or twisting while stationary or while being moved by the electric motor 140.

In one embodiment, the slide track 141 is oriented such that it tilts at set angle between 3% and 15% from the bottom of the slide track 141 to the top of the slide track 141 (being further from the user at the top than the bottom). Advantageously, this tilted slide track 141 allows a user to obtain the maximum stretch because as the user's leg raises, it does not extend as much horizontally. In one embodiment, the slide track tilts at a 10% or 12% angle. In other embodiments, the slide track 141 is oriented such that it tilts at set angle between 5% and 15%, 8% and 12%, 5% and 10%, or 7% and 15%.

In some embodiments, the slide track 141 angle is adjustable.

In the preferred embodiment, the foot rest apparatus 142 includes a base section 142' having a foot rest pad 143, a loop belt 144 which hangs from the front of the base section 142', a plurality of step bars 145 positioned above the foot rest pad 143, and a lower cord 146 which extends vertically from the bottom of the base section 142'. In some embodiments, two cord handles 147 is attached to the end of the lower cord 146 opposite its attachment to the base section 142'.

In the preferred embodiment, a base pulley 115 is disposed on the base stand 113 and is operative to receive the lower cord 146, thereby allowing the direction of operation of the lower cord 146 to be changed so as to operate along a substantially horizontal plane.

It is contemplated that the electric motor 140 is manually operated through a plurality of push buttons 148 operative as biased, momentary push-button switches, disposed in various locations on the elongated base frame 110, hand grip frames 120, and/or foot stands 130, including on both the left and right sides, respectively, thereon. As such, it is appreciated that the elongated base frame 110, hand grip frames 120, and foot stands 130 include internal electrical wiring which operatively connect a power source, defined in the illustrated embodiment as an electrical cord 149, the electric motor 140, and each of the push buttons 148.

In an embodiment, the push buttons 148 can be color coded. For example, in an embodiment green buttons are pressed to cause the foot rest apparatus 142 to rise and red buttons are pressed to cause the foot rest apparatus 142 to be lowered. In other embodiments any other color scheme can be used to indicate the operative features of the stretching machine.

In other embodiments, the locations of the buttons can indicate the associated control function. For example, a push button 148 the right side foot stand 130 may cause the foot rest apparatus 142 to rise (as such, a "retract push button") and push button 148 the left side foot stand 130 may cause the foot rest apparatus 142 to be lowered (as such, a "deploy push button"). Such may be implemented with or without color coding.

It is appreciated that by including push buttons 148 on the elongated base frame 110, hand grip frames 120, and foot stands 130, a user will generally be able to operate the foot rest apparatus 142 no matter what area of the body is being stretched. For example, push buttons 148 in certain locations may be more or less accessible to a user doing upper or lower back stretches.

In typical embodiments, the push buttons 148 operate as push to make electrical switches. In some embodiments, the electrical motor 140 only operates while the push button 148 is pressed. In other embodiments, the electrical motor 140 includes a programmable timer function which allows it to automatically operate for a set period of time once one of the push buttons 148 has been actuated. For example, in such an embodiment, a user can press one of the push buttons 148 to cause the motor 140 to either hold the foot rest apparatus 142 in place or move the foot rest apparatus 142 in a desired direction for a set duration (such as 10 or 15 seconds), allowing a user to hold a desired stretch for the duration without having to hold the push button 148.

While the push buttons 148 generally define biased momentary switches, in some embodiments, the push buttons 148 may operate as a toggle on/off switch.

When in use, a user can stand in front of motorized stretching machine 100 and place his foot in the loop belt 144 or on the foot rest pad 143 then hold onto one or two of the hand grip frames 120. The user can then press one of the retract push buttons 148 to cause the motor 140 to retract the cable 143 upwards to stretch the user's leg and leg muscles. When the user wishes to stop the movement, he/she can release the push button 148. When the user wishes to return to a normal position, the user can press one of the deploy push buttons 148 to cause the motor 140 to unspool the cable 143 to lower the user's foot out of the stretched position. Below are some possible stretches that can be performed with the motorized stretching machine 100. In general, the machine is used with the user standing or seated in front of the motorized stretching machine 100.

Stretching Gluteus Maximus Muscles. This stretch can start with the user standing sideways with the body approximately perpendicular to the front of the motorized stretching machine 100, facing the left hand grip frame 120 to stretch the left gluteus maximum muscle. The user brings his/her left leg into the loop belt 144 or on the foot rest pad 143 (while in the lowered position) and may hold onto a bar on the left hand grip frame 120 in the middle torso height. By pressing one of the retract push buttons 148, the user starts to feel the stretching into the gluteus maximus as the foot rest apparatus 142 raises. The body position relative to the machine can be switched to stretch the right gluteus maximum muscle.

Figure 7:
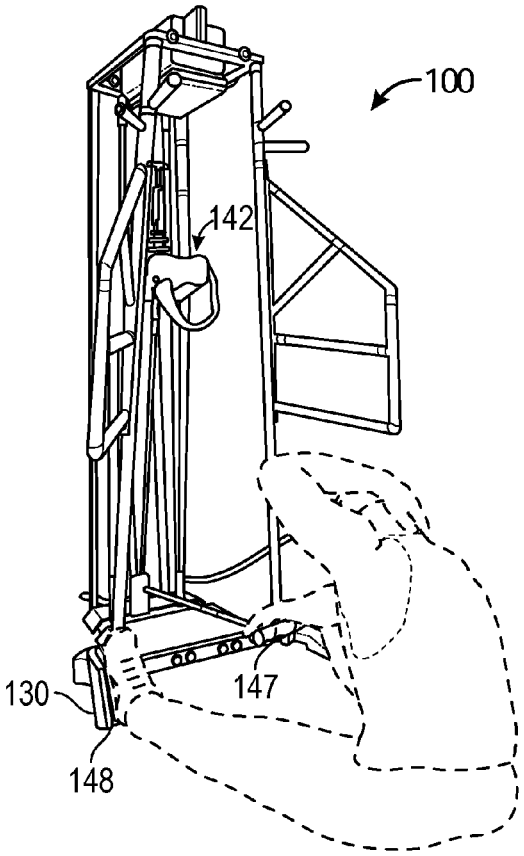
FIG. 7 is a front perspective view of a motorized stretching machine built in accordance with an embodiment of the present invention with a user grasping a cord handle.

Stretching Lower Back Muscles. As illustrated in FIG. 7, this stretch can start with the user sitting down in front of the machine and placing the right and left foot on the corresponding foot stands 130 on the front edge of the motorized stretching machine 100. A user the holds the cord handle 147 with one or both hands in order to be pulled forward. The user can control the stretch (namely, raise and lower the foot rest apparatus 142) by using the push buttons 148 on the foot stands 130 with the right or left foot.

Stretching Latissmus Dorsi Muscles. This stretch can start with the user sitting down and possibly placing the right and left foot on the corresponding foot stands 130. The user can hold the loop belt 144 and optionally the hand grip frame

120 opposite the side to be stretched, controlling the foot rest apparatus 142 by using the push buttons 148 on the foot stands 130.

Figure 6:
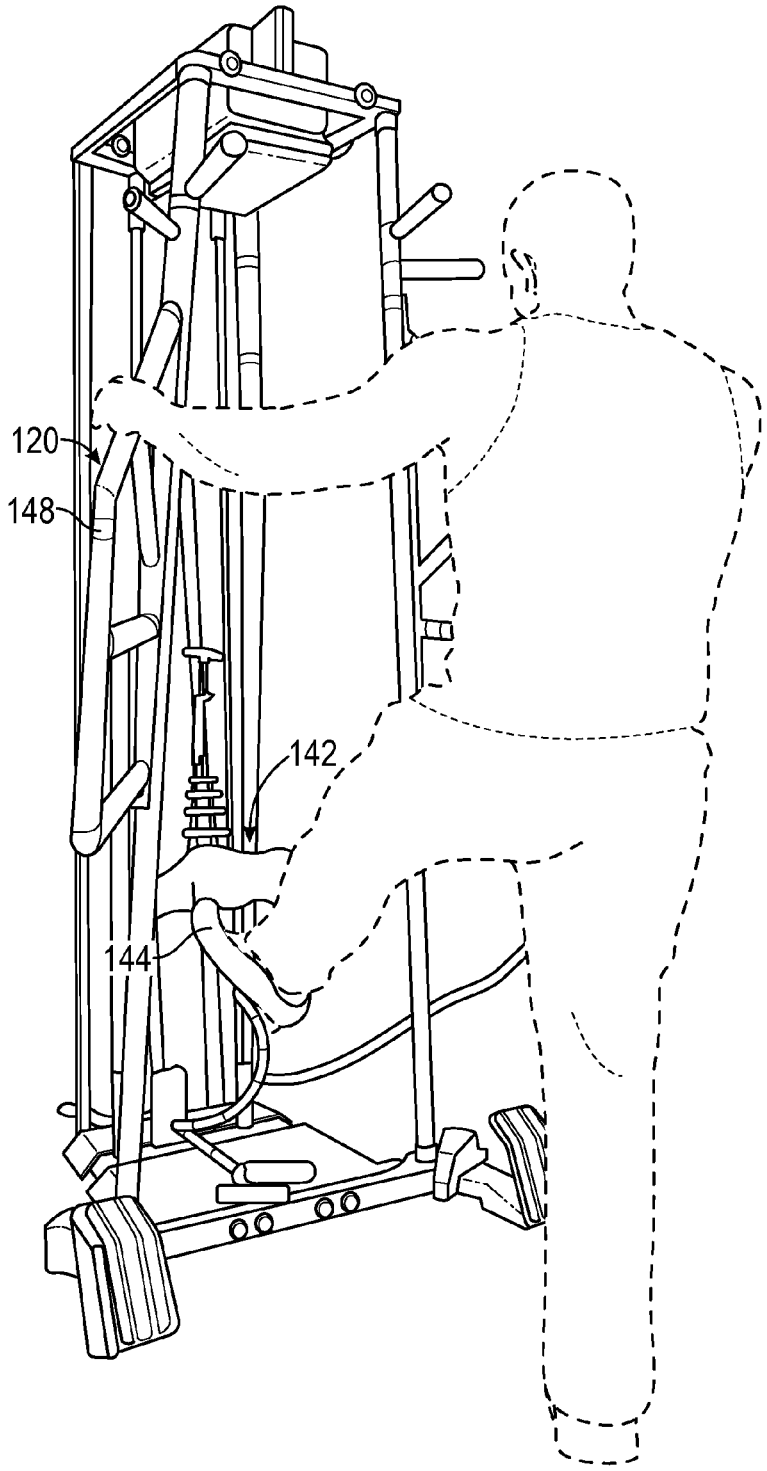
FIG. 6 is a front perspective view of a motorized stretching machine built in accordance with an embodiment of the present invention with a user's foot in its loop belt.

Stretching Hamstring Muscles. As illustrated in FIG. 6, this stretch can start with the user directly facing the machine, holding onto the right and left hand grip frames 120 with the respective hand, and placing foot of the target leg on the loop belt 144. The foot rest apparatus 142 can then be raised to actuate the stretch using the push buttons 148 on the hand grip frames 120.

Figure 5:
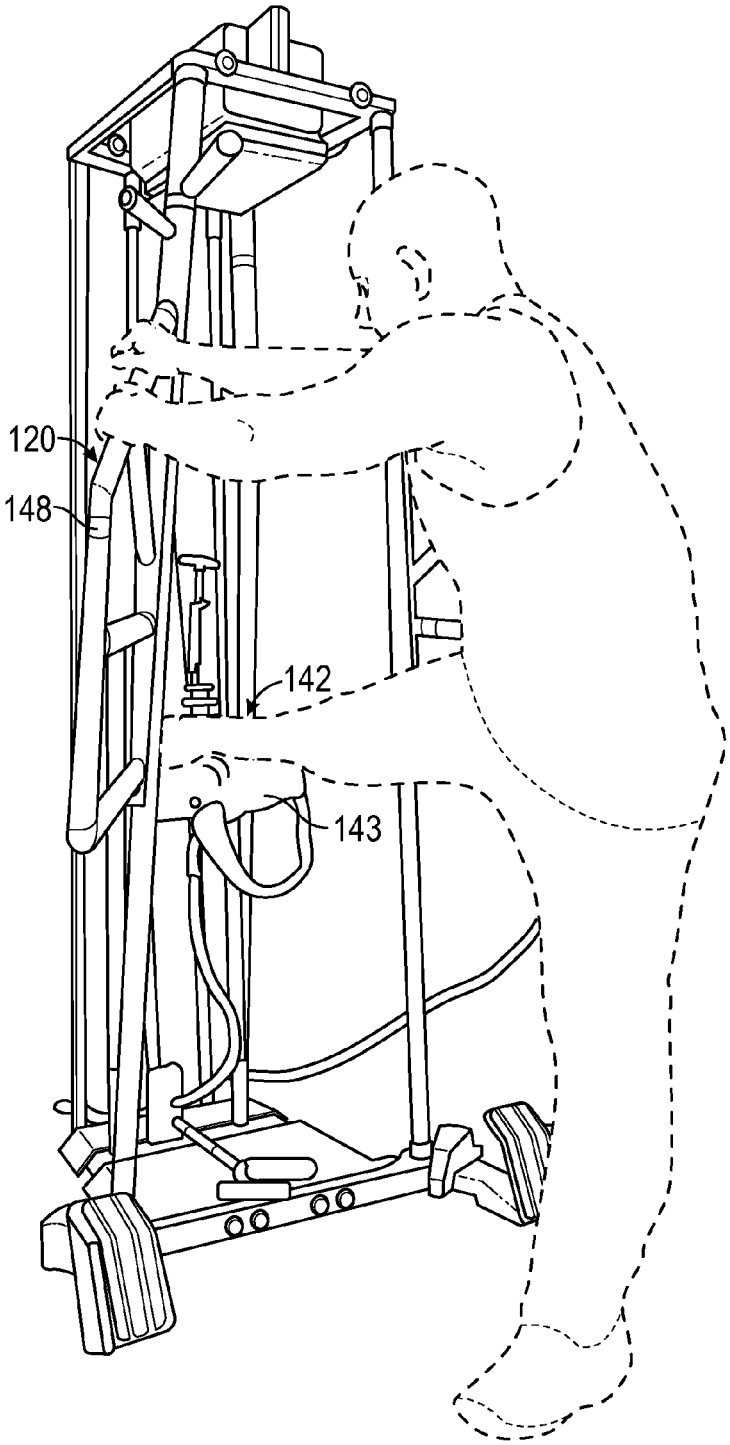
FIG. 5 is a front perspective view of a motorized stretching machine built in accordance with an embodiment of the present invention with a user's foot on its foot rest pad.

Stretching Abductor Magnus Muscles. As illustrated in FIG. 5, this stretch can start with the user standing sideways in front of the motorized stretching machine 100. The user places their right foot onto the foot rest pad 143. The user can hold the left side hand grip frame 120 with both hands. The foot rest apparatus 142 can then be raised to actuate the stretch using the push buttons 148 on the hand grip frame 120. The body position is reversed to stretch the left abductor magnus muscles.

Stretching Quadriceps Muscles. This stretch can start with the user facing away from the motorized stretching machine 100. The user must place one foot behind their body into the loop belt 144 and the user's left hand can grasp the left hand grip frame 120 at a lower torso height and the user's right hand can grasp the right hand grip frame 120 at a lower torso height. The user must hold onto the hand grip frame 120 and use the push buttons 148 thereon to control the stretch.

Stretching Hip Muscles. This stretch can start with the user facing forward. The user places one foot on the loop belt 144, bending the knee forward and holding the hand grip frame 120 while pushing the push buttons 148 thereon to control the stretch.

Stretching Chest Muscles. This stretch can start with the user facing away from the motorized stretching machine 100. The user holds right and left hand grip frames 120 while slowly leaning further away from the machine until the user feels the stretch.

Stretching Calf Muscles. This stretch can start with the user facing forward and placing one foot on top of the foot stand 130. By lowering the heal, the user will feel the stretch.

Suspended Stretch for Several Muscles Groups. This stretch can start with the user facing forward. The user can place both feet on the foot rest pad 143, holds onto right and left hand grip frame 120 and pushes a retract push button 148 to the desired level of stretch. Once user is satisfied with current stretch, he can obtain a different stretch by reaching for opposite sides of the hand grip frame 120 while the user's feet remain suspended on the foot rest pad to engage different muscles group stretches, such as Latissmus dorsi, Shoulder Muscles, neck, Oblique Muscles and triceps.

Figure 8:
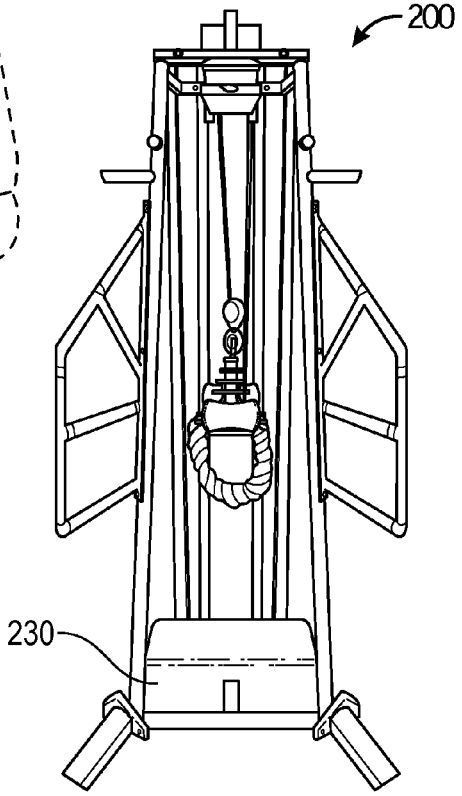
FIG. 8 is a front elevational view of a motorized stretching machine built in accordance with an alternate embodiment of the present invention.

Referring now to FIG. 8, in an alternate embodiment of the motorized stretching machine 200, a single elongated foot bar 230 is used in place of the dual rigid foot stands.

In all embodiments, it is generally contemplated that the hand grip frames provide the user full stability and control while stretching. The hand grip frames also allow the user to engage several different muscles groups at the same time instead of just focusing on one muscle group. While the hand grip frames generally include a left side mounted on the left side of the slide track and a right side mounted to the right side of the slide track, it is contemplated that other orientations may be employed. The hand grip frame can include a plurality of bars that extend horizontally relative to the left and right sides of the slide track. In one embodiment, the hand grip frame can have the following horizontal grip bars: upper, upper middle, lower middle and lower. The hand grip frame can also include vertical grip bars that extend parallel to the slide track and are coupled to the ends of the horizontal members as well additional grip bars on a wider portion of the frame that extend from the left and right sides of the plurality of grip bars that extend horizontally.

The foot rest apparatus is generally an elongated horizontal structure that moves vertically along the slide track and includes features that provide multiple user options. For example, many embodiments the foot rest apparatus include a foot rest pad and a loop belt. The user may choose to use either the pad or belt depending upon the type of stretching being performed. The pad can be a padded structure that rests on top of a base section of the foot rest. The pad can allow a user to place a foot on top of the foot rest comfortably while the foot rest moves vertically along the slide track. The user can also put his or her foot in the belt below the foot rest. The belt can be a flexible structure that can be made of fabric, webbing, plastic, rubber or any other suitable material or structure. The belt is generally coupled to the bottom of the foot rest, but may be attached in other areas. The user may place a foot in the belt which can partially surround the foot. The belt may also be padded to improve the comfort to the user.

The motor can be any type of suitable electric motor including: synchronous and asynchronous DC motors and AC motors. In an embodiment, the motor can be a stepper motor which is similar to a three-phase AC synchronous motors. Unlike a synchronous motor, in its application, the stepper motor may not rotate continuously; instead, it "steps"—starts and then quickly stops again—from one position to the next as field windings are energized and de-energized in sequence. Depending on the sequence, the rotor may turn forwards or backwards, and it may change direction, stop, speed up or slow down arbitrarily at any time. Simple stepper motor drivers entirely energize or entirely de-energize the field windings, leading the rotor to "cog" to a limited number of positions; more sophisticated drivers can proportionally control the power to the field windings, allowing the rotors to position between the cog points and thereby rotate extremely smoothly. This mode of operation is often called micro-stepping. Computer controlled stepper motors are one of the most versatile forms of positioning systems, particularly when part of a digital servo-controlled system. Stepper motors can be rotated to a specific angle in discrete steps.

The slide track is generally a track that supports the foot rest and guides the foot rest apparatus as it slides vertically relative to the elongated base frame of the motorized stretching machine. The slide track can include linear-motion bearings that will allow the foot rest to move smoothly with minimal friction. A linear-motion bearing or linear slide is a bearing designed to provide free motion in one dimension. There are many different types of linear motion bearings including rolling element bearings, ball bearing slides, plain bearings, dove tail slides.

A rolling-element bearing is generally composed of a sleeve-like outer ring and several rows of balls retained by cages. The cages were originally machined from solid metal and were quickly replaced by stampings. It features smooth motion, low friction, high rigidity and long life. They are economical, and easy to maintain and replace.

Ball bearing slides offer smooth precision motion along a single-axis linear design, aided by ball bearings housed in the linear base, with self lubrication properties that increase reliability. Ball bearing slides are commonly constructed from materials such as aluminum, hardened cold rolled steel and galvanized steel, ball bearing slides can consist of two linear rows of ball bearings contained by four rods and located on differing sides of the base, which support the carriage for smooth linear movement along the ball bearings.

Roller slides also known as crossed roller slides are linear slides that provide low friction linear movement. Roller slides consist of a stationary linear base and a moving carriage, roller slides work similarly to ball bearing slides, except that the bearings housed within the carriage are cylinder-shaped instead of ball shaped. In an embodiment, the rollers crisscross each other at a 90° angle and move between the four semi-flat and parallel rods that surround the rollers. The rollers can be between "V" grooved bearing races, one being on the top carriage and the other on the base. The travel of the carriage ends when it meets the end cap, a limiting component. Typically, carriages are constructed from aluminum and the rods and rollers are constructed from steel, while the end caps are constructed from stainless steel.

Plain bearings are very similar in design to rolling-element bearings, except they slide without the use of ball bearings. Plain bearings can run on hardened steel or stainless steel shafting (raceways), or can be run on hard anodized aluminum or soft steel or aluminum. The specific type of polymer/fluoro-polymer will determine what hardness is allowed.

Dovetail slides, or dovetail way slides are typically constructed from cast iron, but can also be constructed from hard-coat aluminum, stainless steel or other suitable materials Like any bearing, a dovetail slide is composed of a stationary linear base and a moving carriage. A dovetail carriage can have a V-shaped, or dovetail-shaped protruding channel which locks into the linear base's correspondingly shaped groove. Once the dovetail carriage is fitted into its base's channel, the carriage is locked into the channel's linear axis and allows free linear movement. When a platform is attached to the carriage of a dovetail slide, a dovetail table is created, offering extended load carrying capabilities, Since dovetail slides have such a large surface contact area, a greater force is required to move the saddle than other linear slides, which results in slower acceleration rates. Dovetail slides are capable of long travel, dovetail slides are more resistant to shock than other bearings, and they are mostly immune to chemical, dust and dirt contamination.

In another embodiment, the motor can be coupled to a threaded rod that extends along the slide track. The foot rest apparatus can have a corresponding threaded mechanism that engages the threaded rod. The motor can spin the rod in a first direction which causes the foot rest to rise or spin in the opposite direction which causes the foot rest to be lowered. In other embodiments, other mechanisms can be coupled to the motor to move the foot rest apparatus.

The base frame and hand grip frames of the motorized stretching machine can be fabricated from any suitable bar stock material that can be securely fastened together. In an embodiment, the base frame and hand grip frames can be made of metal pipe or tubing that is strong enough to support the weight of a user and of a diameter that is comfortable to grip. The pipes/tubing can be any suitable metal, plastic or composite material, such as steel, copper, aluminum, PVC, Kevlar, carbon fiber, etc. The preferred diameter of the grip bars of the hand grip frames can be about ½ inch to 2 inches in diameter. The pipes/tubes can be cut to the required lengths and then coupled together in an appropriate manner to create the hand grip frame. For example, metal pipe pieces can be welded or fastened together to create the hand grip frame. Alternatively, plastic or composite pipe pieces can be bonded, fastened or molded together to create the hand grip frame.

The push buttons are coupled to the electric motor and the electrical power source so that when any push button is pressed, the electrical power is supplied to the motor to cause the motor to generate rotate in a first or second opposing direction. If a DC motor and power supply are being used, the switches can apply the DC power in a first polarity to the DC motor when the raise button is pressed and conversely, a second polarity that is opposite the first polarity to the DC motor when the lower button is pressed. If both the raise and lower buttons are both pressed simultaneously, the electrical system can stop power from being applied to the DC motor and also prevent an electrical power supply short circuit.

In other embodiments, the motor can be stepper motor that is coupled to a control computer. The computer can be configured to provide specific operating controls to the stepper motor such as movement speed limitations, movement distance limitations, etc. The limitations can be set for all users or set for individual users and can provide an additional safe guard against improper use. For example, the system can be configured to move the foot rest apparatus at a first speed but slow the foot rest apparatus down as it approaches the movement distance limits of a designated user.

It is appreciated that the motorized stretching machine can assist in activities ranging from rehabilitation and physical therapy to competitive athletics.

It is contemplated that in alternate embodiment, the motor may be integrated with or adjacent to the base stand as opposed to the top section.

In some embodiments, one or both foot stands are constructed as a fixed member without any integrated or connected push buttons.

In some embodiments, an integrated vertical measurement scale is positioned adjacent to the slide track and running parallel thereto. An example of such a scale is illustrated in FIG. 1 as reference number 150. It is contemplated that a single scale may be provided on one of the slide tracks, or dual scales may be provided, with each adjacent to the slide track on disposed on either side of the cable. In one embodiment, measurement markings are included on the one or both of the actual slide track.

The present invention has been shown and described herein in what is considered to be the most practical and preferred embodiment. It is recognized, however, that departures may be made therefrom within the scope of the invention and that obvious modifications will occur to a person skilled in the art.

What is claimed is:

1. A motorized stretching machine, comprising:

an elongated base frame having front side and including opposing side frame members, a bottom base and a top section, wherein each of the opposing side frame members are oriented substantially upright, extending between the bottom base and top section; and a motorized assembly integral with said base frame having a suspended member movably positioned between the bottom base and top section, wherein said motorized assembly is configured to selectively lower and raise the suspended member; wherein the suspended member defines a foot rest apparatus which includes a platform having a top and bottom and at least one of a pad disposed on the top of the platform, a loop belt which hangs from the platform, and a lower cord which hangs from the bottom of the platform;

wherein the platform includes the lower cord hanging vertically from the bottom of the platform; and the bottom base includes a base pulley disposed thereon, thereby allowing the direction of operation of the lower cord to be changed so as to operate along a substantially horizontal plane.

2. The motorized stretching machine of claim 1, additionally comprising at least one hand grip frame attached to the at least one of the side frame members, wherein each of said at least one hand grip frames extend from the front side of the base frame and include at least one manual actuator adapted to cause the motorized assembly to selectively lower and raise the suspended member.

3. The motorized stretching machine of claim 2, wherein each side frame member includes at least one of said hand grip frames attached thereto.

4. The motorized stretching machine of claim 1, additionally comprising at least one foot stand attached to at least one of the side frame members, wherein said at least one foot stand extends from the front side of the base frame and includes at least one manual actuator adapted to cause the motorized assembly to selectively lower and raise the suspended member.

5. The motorized stretching machine of claim 1, wherein the motorized assembly includes a slide track fixedly attached to the bottom base and top section.

6. The motorized stretching machine of claim 5, wherein the slide track is tilted at a set angle between 3% to 15% such that the slide track is attached to the bottom base at a proximal location relative to the front side compared to where the slide track is attached to the top section.

7. The motorized stretching machine of claim 5, wherein the suspended member is slidably disposed on the slide track.

8. The motorized stretching machine of claim 1, wherein said motorized assembly includes an electric motor coupled with the top section and is configured to selectively lower and raise the suspended member through a cable coupled with the suspended member and a spool selectively rotatable by the electric motor.

9. The motorized stretching machine of claim 8, wherein said electric motor includes a programmable timer function which allows it to automatically operate for a set period of time once activated.

10. A motorized stretching machine, comprising:

an elongated base frame having front side and including opposing side frame members, a bottom base and a top section, wherein each of the opposing side frame members are oriented substantially upright, extending between the bottom base and top section;

a motorized assembly integral with said base frame having a suspended member movably positioned between the bottom base and top section, wherein said motorized assembly includes a slide track fixedly attached to the bottom base and top section and is configured to selectively lower and raise the suspended member;

at least one hand grip frame attached to the at least one of the side frame members, wherein each of said at least one hand grip frames extend from the front side of the base frame and include at least one manual actuator adapted to cause the motorized assembly to selectively lower and raise the suspended member the suspended member defines a foot rest apparatus which includes a platform having a top and bottom and at least one of a pad disposed on the top of the platform, a loop belt which hangs from the platform, and a lower cord which hangs from the bottom of the platform;

the platform includes the lower cord hanging vertically from the bottom of the platform; and the bottom base includes a base pulley disposed thereon, thereby allowing the direction of operation of the lower cord to be changed so as to operate along a substantially horizontal plane.

11. The motorized stretching machine of claim 10, additionally comprising at least one foot stand attached to at least one of the side frame members, wherein said at least one foot stand extends from the front side of the base frame and includes at least one manual actuator adapted to cause the motorized assembly to selectively lower and raise the suspended member.

12. The motorized stretching machine of claim 10, wherein the slide track has a tilted at a set angle between 3% to 15% such that the slide track is attached to the bottom base at a proximal location relative to the front side compared to where the slide track is attached to the top section.

13. The motorized stretching machine of claim 10, wherein the suspended member is slidably disposed on the slide track.

14. The motorized stretching machine of claim 10, wherein said motorized assembly includes an electric motor coupled with the top section and is configured to selectively lower and raise the suspended member through a cable coupled with the suspended member and a spool selectively rotatable by the electric motor.

15. The motorized stretching machine of claim 14, wherein said electric motor includes a programmable timer function which allows it to automatically operate for a set period of time once activated.

16. A motorized stretching machine, comprising:

an elongated base frame having front side and defining at least one left frame member, at least one right frame member, a bottom base and a top section, wherein the at least one left frame member and at least one right frame member each extend between the bottom base and top section such that the at least one left frame member and at least one right frame member are oriented substantially upright;

a motorized assembly including an electric motor coupled with the top section, a slide track fixedly attached to the bottom base and top section, and a foot rest apparatus slidably disposed on the slide track, wherein said motorized assembly is configured to selectively lower and raise the foot rest apparatus along the slide track;

said foot rest apparatus defining a platform having a top and bottom which includes at least a lower cord which hangs from the bottom of the platform;

said bottom base including a base pulley disposed thereon, thereby allowing the direction of operation of the lower cord to be changed so as to operate along a substantially horizontal plane;

a left hand grip frame attached to the at least one left frame member and a right hand grip frame attached to the at least one right frame member, wherein said left hand grip frame and right hand grip frame extend from the front side of the base frame, each include at least one manual actuator adapted to cause the motorized assembly to selectively lower and raise the foot rest apparatus, and each include a plurality of intersecting grip bars; and at least one foot stand attached to at least one of the at least one left frame member and at least one right frame member, wherein said at least one foot stand extends from the front side of the base frame and includes at least one manual actuator adapted to cause the motorized assembly to selectively lower and raise the foot rest apparatus.

* * * * *